US006223670B1

(12) United States Patent
Schulze

(10) Patent No.: US 6,223,670 B1
(45) Date of Patent: May 1, 2001

(54) VISUAL GUARD FOR A DOCK CLEAT

(76) Inventor: Clayton E. Schulze, 8282 McKee Rd., Albion, PA (US) 16401

( * ) Notice: Subject to any disclaimer, the term of this patent is extended or adjusted under 35 U.S.C. 154(b) by 0 days.

(21) Appl. No.: 09/680,357

(22) Filed: Oct. 5, 2000

(51) Int. Cl.[7] ..... B63B 21/04
(52) U.S. Cl. ..... 114/218
(58) Field of Search ..... 114/343, 218; 24/115 R

(56) References Cited

U.S. PATENT DOCUMENTS 3,198,160 * 8/1965 Anderson ..... 114/219
4,685,500 * 8/1987 Silvia ..... 150/52 R
5,327,844 * 7/1994 Kress ..... 114/218
5,826,531 * 10/1998 Havnaer, Jr. ..... 114/218

* cited by examiner

*Primary Examiner*—Ed Swinehart
(74) *Attorney, Agent, or Firm*—Richard K. Thomson

(57) ABSTRACT

A flat oblong piece of brightly colored, durable, stretchable elastomeric material has a pair of apertures spaced by approximately 2" less than the outermost reaches of the cleat arms. The visual guard may be stretched over the arms of the cleat and provides a visual warning to passersby without interfering with the function of the cleat: a rope may be attached above or below the guard without inhibiting its function.

7 Claims, 1 Drawing Sheet

VISUAL GUARD FOR A DOCK CLEAT

BACKGROUND AND SUMMARY OF THE INVENTION

The present invention is directed to a visual guard for a dock cleat that does not interfere with its use, allowing a rope to be attached either above or below the guard.

Docks are equipped with cleats to permit boats to be tied off by securing a rope thereto. The cleat, whether or not it has a rope attached, is a danger to a pedestrian walking along the dock. In addition to the physical harm to the walker's toe or foot, the cleat can cause the pedestrian to lose her/his balance and possibly fall in the water.

Several attempts have been made to try to solve this problem. For example, Silvia (U.S. Pat. No. 4,685,500), Kress (U.S. Pat. No. 5,327,844), and Havnaer, Jr. (U.S. Pat. No. 5,826,531) provide cleat covers. Each of these patents provides an elastomeric cover whose purpose is to prevent physical contact with the dock cleat. They each provide some means to accommodate a rope which has been attached to the cleat. The problem is, that should a person desire to tie/untie a boat to/from the cleat, it is necessary to remove the cover. The cleat cover can then become windblown, forgotten, or otherwise misplaced rather than replaced and the result is the dock cleat continues to be a potential threat to a person walking on the dock. Further, these designs are large since they cover the entire cleat and are comparatively complicated to manufacture with a resultant impact on cost.

The present invention provides an elegantly simple device to provide, primarily, visual protection to a passerby. The cleat guard of the present invention comprises an oblong, flat piece of brightly colored, stretchable elastomeric material that has a pair of openings spaced apart by a distance at least 2" less than the outer reach of the arms of the cleat upon which the guard is to be used. The elastomeric material is preferably an iridescent orange that visually calls attention to the presence of the dock cleat. In addition, phosphorescent chemicals are preferably blended into the guard material enabling it to be seen at night. The visual guard of the present invention is designed to allow use of the cleat with out the need to remove it, i.e., a rope may be attached to the cleat either over or under the cleat guard without compromising the function of the guard nor the cleat. In this manner, the guard continues to function without risking loss or misplacement resulting from removal nor threatening passersby with an unguarded cleat. Since the cleat guard is elastomeric it will afford some resistance to physical contact but, since a major portion of the cleat remains exposed to permit its use, the primary protection provided by the guard of the present invention is to a visual warning.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
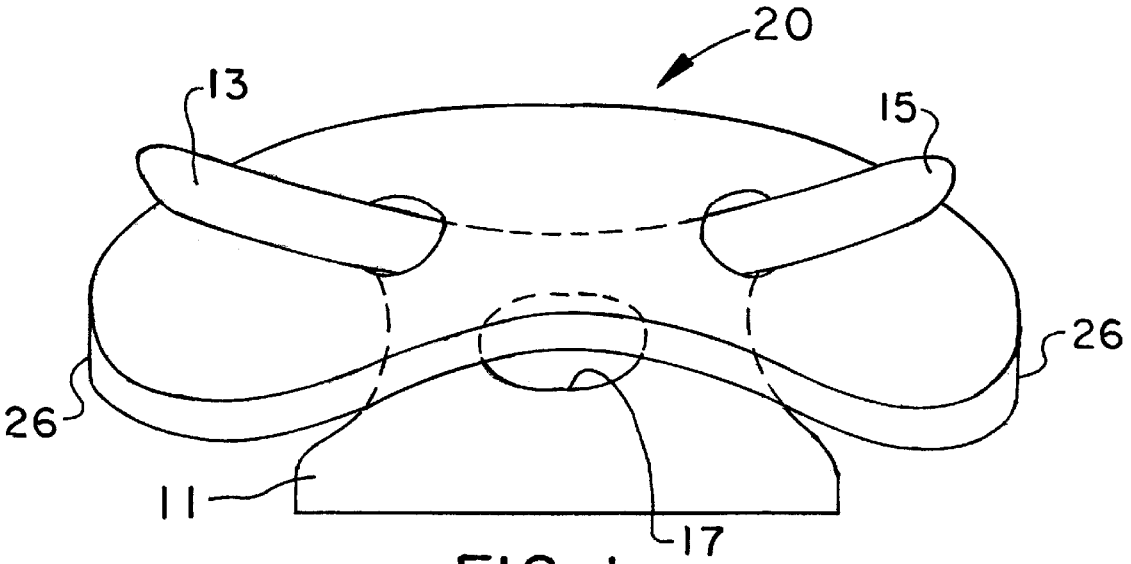
FIG. 1 is a perspective view of a first embodiment of the visual guard for a dock cleat of the present invention.
Figure 2:
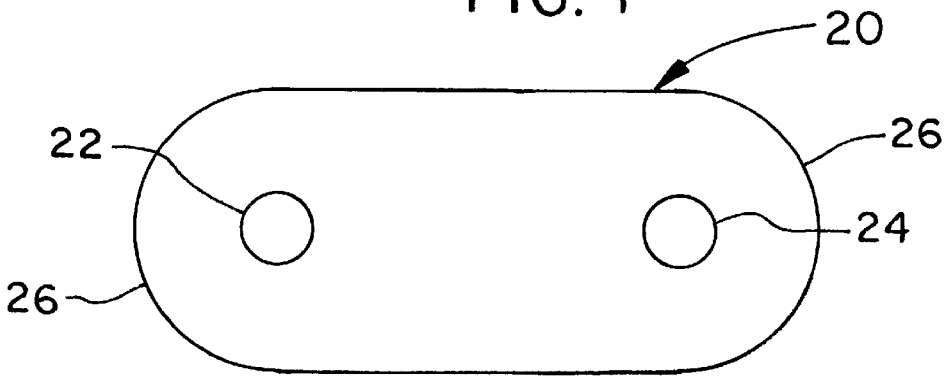
FIG. 2 is a top view of the guard of the first embodiment.
Figure 3:
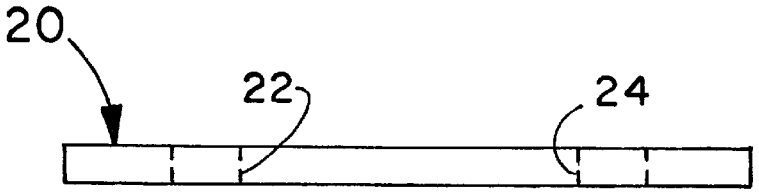
FIG. 3 is an edge view of the guard of the first embodiment.

The first preferred embodiment of the visual guard for a dock cleat is shown in FIGS. 1–3 generally at 20. Guard 20 is flat and generally rectangular with rounded ends 26 (oblong) and has a first opening 22 and a second opening 24 spaced by a distance generally about 2" less than the distance between the outermost reaches of first (13) and second (15) arms on dock cleat 11. A suitable material for the guard of the present invention is a hybrid of SBR rubber and PVC identified as SCM available from Rubatex Corp., 5223 Valley Park Dr., Roanoke, Va. 24019. Other suitable elastomeric materials could also be used. Such alternative materials should have a comparable durometer (50–55 Shore), resistance to ultraviolet radiation, be buoyant, non-absorbent, tough, durable, with good resistance to petroleum products. It is also preferred that the pigment, a bright orange of the type used for life jackets and the like, be incorporated directly into the elastomer so that it cannot chip, peel or flake off the guard 20. Further, preferably phosphorescent material is incorporated with the orange pigment so that the cleat guard 20 can be seen at night.

As seen in FIG. 1, when deployed, guard 20 leaves cleat arms 13, 15 and through bore 17 of cleat 11 available for securing of a hawser. The rope may be attached above or below the guard 20 without impairing the function thereof and, similarly, the presence of guard 20 on cleat 11 does not adversely impact the use of cleat 11. Accordingly, unlike other cleat guards, guard 20 need not be removed to attach or detach a rope securing a boat to the dock and is therefore not at risk to be lost, or simply forgotten once the rope is untied and the boat casts off The visual guard 20 of the present invention will provide some physical protection to a passerby, in the same manner a curb feeler affords some protection against a curb contacting the sidewall of a tire. However, the primary protection for persons is the brightly colored guard 20 calling visual attention to the presence of the cleat 11 so the passerby can alter her/his footfall to avoid contact therewith. The phosphorescent chemicals introduced into the guard material enables it to be seen at night. The cleat guard 20 of the present invention is simple and inexpensive and less likely to become lost, greatly increasing its effectiveness.

While the cleat guard 20 has been disclosed for use on dock cleats, it is conceivable that a smaller version could be used on the deck cleats of some larger boats to similarly visually warn those walking the decks or the presence of the cleat reducing incidents of undesired contact between their foot and the cleat. It will be understood that a variety of sizes of guards 20 will be required to accommodate the variety of different sizes of cleats.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A visual guard for cleats on a dock, comprising an oblong, flat piece of brightly colored, stretchable elastomeric material having first and second openings with a center-to-center distance less than a distance between an outer reach of a first cleat arm and an outer reach of a second cleat arm, whereby said visual guard may be stretched over the first and second cleat arms to provide someone walking on the dock with a visual warning without interfering with the securing of a rope above or below said visual guard.

2. The visual guard for cleats of claim 1 wherein the brightly colored elastomeric material is iridescent orange.

3. The visual guard for cleats of claim 1 wherein said oblong, flat piece of elastomeric material is generally rectangular with rounded ends.

4. The visual guard for cleats of claim 1 wherein said center-to-center distance between said first and second openings in said oblong, flat piece of elastomeric material is at least 2" less than said outer reach of a first cleat arm and an outer reach of a second cleat arm.

5. The visual guard for cleats of claim 1 wherein the cleat guard is made of a tough, stretchable elastomeric material that is resistant to ultraviolet radiation and petroleum products.

6. The visual guard for cleats of claim 1 wherein said guard is made of a hybrid SBR rubber and PVC material having a Shore durometer in the range of between 50 and 55.

7. The visual guard for cleats of claim 1 further comprising phosphorescent material incorporated into stretchable elastomeric material enabling said guard to be seen at night.

* * * * *